United States Patent [19]

Wheeler

[11] 4,027,410

[45] June 7, 1977

[54] PLANT STAKE

[75] Inventor: Philip T. Wheeler, Dewitt, Mich.

[73] Assignee: The John Henry Company, Lansing, Mich.

[22] Filed: Mar. 18, 1976

[21] Appl. No.: 668,212

[52] U.S. Cl. ..... 40/10 C; 47/47

[51] Int. Cl.[2] ..... G09F 3/18

[58] Field of Search ..... 40/10 C, 124.5, 22, 40/10 C, 124.5, 22; D35/1; 47/33, 45, 46, 47

[56] References Cited

UNITED STATES PATENTS

| | | | |
|---|---|---|---|
| 1,896,695 | 2/1933 | Borovicka | 40/10 C |
| 2,625,760 | 1/1953 | Cleal | 40/10 C |

FOREIGN PATENTS OR APPLICATIONS

| | | | |
|---|---|---|---|
| 276,852 | 9/1927 | United Kingdom | 40/10 C |

*Primary Examiner*—Edgar S. Burr
*Assistant Examiner*—James R. Feyrer
*Attorney, Agent, or Firm*—Price, Heneveld, Huizenga & Cooper

[57] ABSTRACT

A stake for identifying a potted plant or seedling and insertable into a soil mixture is formed from a thin, flexible material. The stake includes a generally rectangular body, an integral shaft extending from the body and including at its end, remote from the body a generally triangular-shaped or barbed end integral with the shaft. The stake has a generally curved cross-section and a plurality of raised or embossed ridges extending longitudinally of the stake to increase the rigidity of the stake.

5 Claims, 4 Drawing Figures

PLANT STAKE

BACKGROUND OF THE INVENTION

This invention relates to stake-like articles and more particularly, to a unique identifying stake formed from a thin, flexible material and adapted for insertion into a soil mixture.

Heretofore, various forms of identifying stakes have been proposed. The stakes have been employed to identify a particular plant or seed imbedded within the soil mixture or growing therefrom. Primarily, these stakes are used at the retail sales level and have imprinted thereon the basic information relevant to the identity of the particular plant or seed contained in the plant pot. For example, a full color picture of the plant in a flowering condition may be imprinted on the main portion of the stake. Generally, further information concerning proper spacing, light requirements, the particular purpose for which the plant is generally employed and the plant's or seedling's moisture requirements must be omitted due to space limitations. It would be highly desirable to provide a particular location on the stake at which pricing information may be imprinted as well as detailed cultural instructions, light needs, spacing of plants, moisture requirements, etc. Such stakes with the above information imprinted thereon would reduce the frequency with which a retail sales clerk will be required to answer customer questions concerning the specific plants identified by the stakes.

The various stakes heretofore proposed have generally taken the shape of an elongated, flat member terminating at one end in a sharp projection. Also, such stakes have been stamped from polymeric material such as polyvinyl chloride, polystyrene, and so on. Since such material is relatively flexible, the stake must be relatively thick to provide the desired degree of rigidity to permit insertion into the soil. This naturally significantly increases the cost of such stakes. Further, such prior stakes, sometimes of triangular configuration or smoothly tapered, do not resist removal from the soil. Therefore, either deliberately or through mistake, the various identifying stakes may be easily transferred from one pot to another so as to incorrectly identify the particular plant or seedling as well as the price therefore. In use outdoors, such stakes are easily inadvertently removed and lost.

A need, therefore, exists for a stake which may be formed from a flexible, polymeric material having a reduced thickness than heretofore possible to thereby decrease the cost of manufacture while still providing sufficient rigidity for insertion into the soil. Also, a need exists for an identifying stake of this type which will resist removal from the soil after insertion. Also, a need exists for a stake which provides more room for specific detailed information about the related plant.

SUMMARY OF THE INVENTION

In accordance with the present invention, a unique identifying stake is provided whereby the problems heretofore experienced are substantially reduced. An identifying stake constructed in accordance with the present invention is formable from a thin material as a generally planar, one piece member. The member includes a body portion and a shaft-like portion integral with the body portion and extending outwardly therefrom. A generally triangular-shaped head portion extends outwardly from the shaft-like portion opposite the main body portion. The base of the head portion is dimensioned greater than the transverse dimension of the shaft-like portion to define barb means which may become entangled with root structure within the soil and thereby increase the resistance to withdrawal. The head and the shaft of the stake include longitudinal indentations to significantly increase the rigidity of the stake and thereby reduce the thickness of the material from which the stake is fabricated.

DETAILED DESCRIPTION OF THE PREFERRED EMBODIMENT

Figure 2:
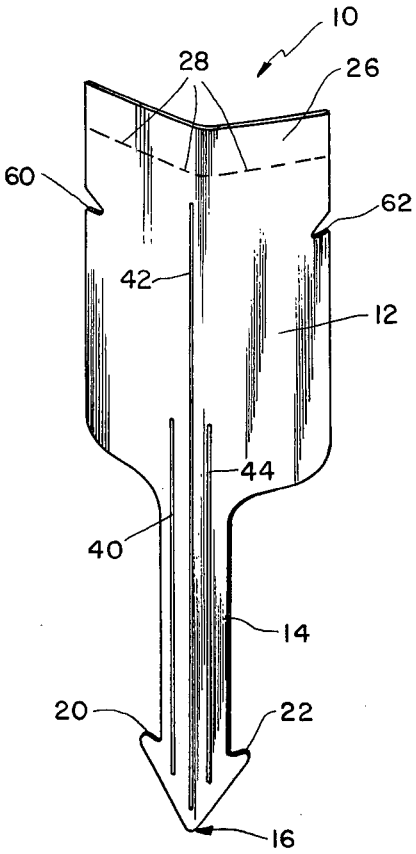
FIG. 2 is a perspective view of the identifying stake illustrated in FIG. 1.
Figure 1:
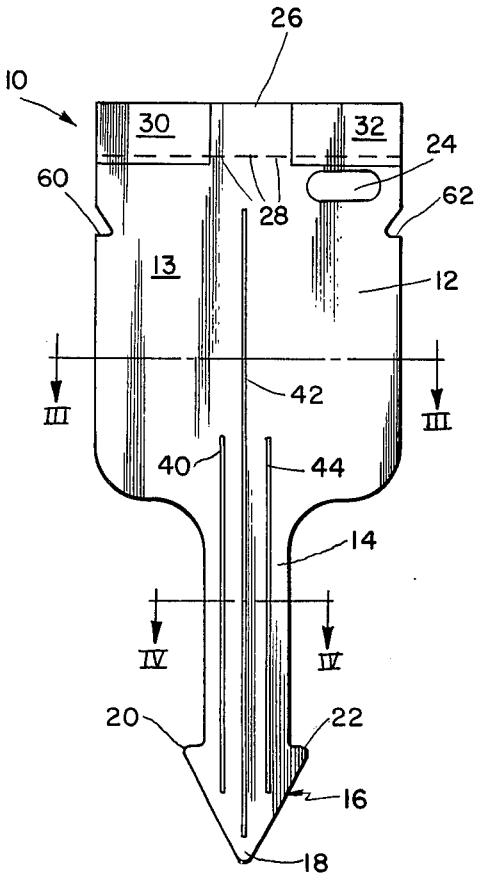
FIG. 1 is a front view of the unique identifying stake in accordance with the present invention.

The preferred embodiment of the unique identifying stake constructed in accordance with the present invention is illustrated in the drawings and generally designated 10. As best seen in FIGS. 1 and 2, the identifying stake is fabricated from a single sheet of material as a generally planar member. In the embodiment shown, the lengthwise, or longitudinal dimension of the stake is substantially greater than its maximum width or transverse dimension. The stake includes a body 12, an integral shaft 14 extending from body 12 and terminating in a head 16. The head has a generally triangular or arrowhead shape terminating in a sharp point 18 and including opposed barbs 20 and 22.

The body 12 has a generally rectangular shape and a width substantially greater than the width of the shaft 14. In the preferred embodiment, body 12 has a width of 2 inches and shaft 14 has a width of 0.6 inches. The first surface 13 of the body provides a ready area for the printing of the various cultural information required when the stake is employed to identify a particular plant or seedling. For example, a full color picture of the plant may be imprinted on the body of the stake. Also, an area 24 may be delineated for the placement of pricing information. The tag, of course, can be imprinted on both sides.

In the preferred embodiment, however, a removable tag-like end 26 is provided for such information. The tag-like portion 26 is separable from the body 12 by a plurality of spaced, transversely extending perforations 28. The perforations 28 would extend in tandem across the main body portion adjacent to, but spaced from the upper edge of the stake. Also, areas 30, 32 of the tag 26 may be provided with color coding information to indicate the moisture and light requirements respectively of the particular plant identified.

Figure 3:
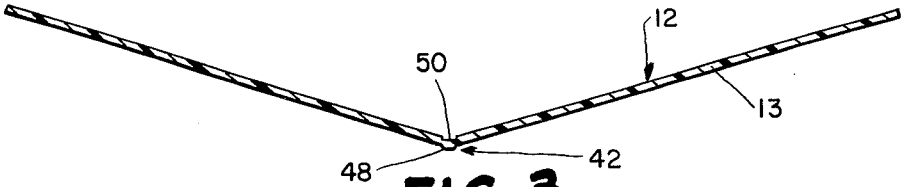
FIG. 3 is a cross-sectional view of the stake taken along line III—III of FIG. 1.
Figure 4:
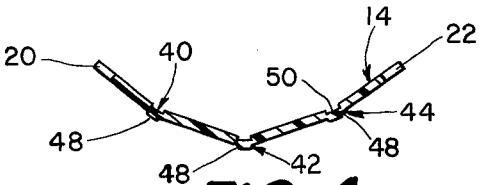
FIG. 4 is a cross-sectional view of the stake taken along line IV—IV of FIG. 1.

As best seen in FIGS. 3 and 4, the stake is generally curved in cross section in order to significantly increase the rigidity of the material employed. In the preferred construction, the stake would be formed from a flexible, polymeric material such as polyvinyl chloride, polystyrene or ABS. By curving the structure during the manufacturing process, the thickness of the material may be decreased from the heretofore required. This results in substantial cost savings.

In order to further increase the structural rigidity of the stake and thereby further decrease the thickness of the material required, a plurality of raised ridges, indentations, or embossments 40, 42 and 44 are provided. These parallel, spaced embossments extend longitudinally of the stake. As best seen in FIGS. 3 and 4, each embossment or raised reinforcement ridge extends above the front surface 13 of the stake. Embossments 40, 44 extend in parallel relationship on opposite sides of the central embossment 42 through substantially the entire head and shaft of the stake. The embossment 42 extends along the longitudinal center line of the stake from a point adjacent tip 18 of the head portion 16 through substantially the entire main body portion of the stake. By forming the stake with raised ridges, indentations, or embossments, as best seen in FIG. 4, the stake is step-wise curved in cross section and includes displaced portions for increasing its rigidity. In the preferred construction, a minimum of three reinforcement ridges are provided. Therefore, the stake is symmetrical about its longitudinal center line.

Each embossment defines a peak or raised portion 48 in one surface thereof (FIG. 3) and a depression or indentation 50 on the oposite surface thereof. The embossments are formed during the manufacturing process with conventional scoring dies that result in permanent deformation of the material from which the stake is formed. As a result, the stake has a permanent, step-wise curved configuration in cross section.

As best seen in FIGS. 1 and 2, the body 12 of the stake also includes opposed notches 60, 62 formed at diametrically opposed points in the longitudinal edges of the body. The notches 60, 62 which are readily die cut during the cutting of the stake outline, provide a convenient place for the consumer to use as a securement of a loop of string extending between a pair of spaced, tandem stakes. As a result, a pair of stakes may be placed in a soil mixture and delineate the particular seedlings or plants imbedded in the mixture along a row. The stake, therefore, has wide application in both outdoor and indoor plant growing situations.

In use, the stake is inserted into the soil contained within a pot, tray, or directly imbedded into the ground in an outdoor garden. The unique shape of the stake, including the curved configuration and the angularly related and displaced portions defined by the embossments, results in a structurally rigid member which is easily insertable into the soil. When employed to identify plants which have already developed some root structure, the arrowhead shaped portion 16 including the barbs 20, 22 serves to prevent or restrain removal of the stake from the soil. The barbed portions 20, 22 will contact the root structure and become entangled therewith so that unintentional or inadvertent removal will be prevented. This feature also prevents rearrangement of the stakes and resulting misidentification of the plants or seedlings, and the prices thereof.

As should be apparent, a plurality of the stakes may be simultaneously formed from a single sheet of relatively thin, polymeric material such as polyvinyl chloride (PVC) having a thickness of about 0.015 inches through the use of appropriate cutting and scoring dies. The thickness of the sheet is approximately three-fourths that heretofore employed. The dies would be configured to form automatically the embossments or reinforcing ridges in each individual stake. Also, the cutting dies may be formed so that adjacent transversely related stakes formed in a single sheet of material are formed in a reverse orientation. As a result, the notches 60, 62 will be formed in the body portion 12 at the same time the barbed portions 20, 22 of the head 16 are formed in adjacent stakes. Such construction of the scoring and cutting dies substantially reduces the steps in the manufacturing of each individual stake.

Therefore, the unique identifying stake in accordance with the present invention is easily and relatively inexpensively manufactured from a thinner sheet of material than heretofore possible. The identifying stake has wide application in the area of retail sales of plants and seedlings as well as in the area of home gardening. Since each stake provides a sufficient area for the printing of cultural information, the amount of time spent by a retail sales clerk in answering questions concerning the particular plants is substantially reduced. Also, by color coding portions of the stake, the specific moisture and light requirements of each individual plant may be readily determined. The stake is sufficiently rigid to be easily insertable into the soil mixture. When employed to identify plants which have developed some root structure, the head portion will resist removal of the stake and therefore reduce the incidence of intentional or inadvertent switching of stakes between plants.

The specific shape of the stake may, of course, be varied from that illustrated in the drawings. The primary requirement being that the stake have a generally curved cross section to increase the rigidity thereof. It is preferred that a plurality of spaced, longitudinally extending indentations be formed in the material to further increase the stake's rigidity. Also, it is preferred that the head portion be generally triangular in shape. The base should be dimensioned greater than the width of the portion of the stake to which the head is joined to thereby define a pair of opposed barbs. Therefore, it is expressly intended that the above description should be considered as that of the preferred embodiment. The true spirit and scope of the present invention will be determined by reference to the appended claims.

The embodiments of the invention in which an exclusive property or privilege is claimed are defined as follows:

1. An identifying stake for insertion into a soil mixture and which is formable from a thin, flexible material yet sufficiently rigid to permit insertion and also capable of reisiting removal from the soil, said stake comprising:

a generally planar body member;

a planar shaft-like member having a width substantially greater than its thickness, integral with said body member and extending outwardly therefrom, said body member having a rectangular shape and a transverse dimension substantially greater than the transverse dimension of said shaft-like member;

a generally triangular-shaped, planar head portion integral with said shaft-like member and extending outwardly therefrom opposite said body member, the base of said head portion being dimensioned greater than the transverse dimension of said shaft-like member to thereby define a barb, said head portion, said body member and said shaft-like member being generally curved in cross-section to thereby increase the rigidity of said stake; and a plurality of indentations extending longitudinally of said head portion, said shaft-like member and said body member for at least a portion thereof, said generally planar body member further defining a pair of opposed inwardly directed notches in the lateral edges thereof spaced from the end of said planar member opposite said head portion, said notches providing convenient points for the securement of string and the like.

2. A stake as defined by claim 1 wherein said indentations are parallel to each other and are equally spaced transversely of said shaft-like member.

3. A stake as defined by claim 2 wherein said body member includes a plurality of spaced, tendemly arranged perforations extending transversely of said body a distance spaced from the transverse edge of said body opposite said shaft member to thereby define a removable tab.

4. A stake as defined by claim 3 wherein said indentations define lines separating angularly related portions of said planar body member so that said body member has a generally step-wise, curved configuration in cross-section.

5. A stake as deined by claim 4 wherein said planar body member, said shaft-like member and said head portion are formed from sheet polyvinyl chloride having a thickness of approximately 0.015 inches.

* * * * *

UNITED STATES PATENT AND TRADEMARK OFFICE

CERTIFICATE OF CORRECTION

PATENT NO. : 4,027,410
DATED : June 7, 1977
INVENTOR(S) : Philip T. Wheeler

It is certified that error appears in the above–identified patent and that said Letters Patent are hereby corrected as shown below:

Column 6, line 8, claim 5:
"deined" should be ---defined---

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*